United States Patent [19]

Kasnick

[11] Patent Number: 4,557,289

[45] Date of Patent: Dec. 10, 1985

[54] HOSE NOZZLE FOR FIRE FIGHTING KIT

[76] Inventor: Richard A. Kasnick, 5481 Vanderbilt Rd., Old Hickory, Tenn. 37138

[21] Appl. No.: 593,402

[22] Filed: Mar. 26, 1984

[51] Int. Cl.[4] ..... B65H 75/36

[52] U.S. Cl. ..... 137/355.28; 251/206; 251/284; 169/51; 285/8; 248/90

[58] Field of Search ..... 137/355.16, 355.28; 251/205, 206, 284; 248/90; 169/51; 285/8, 316

[56] References Cited

U.S. PATENT DOCUMENTS

| | | | |
|---|---|---|---|
| 458,762 | 9/1891 | Charonnat | 251/206 |
| 721,821 | 3/1903 | Myers | 251/206 |
| 2,578,933 | 12/1951 | Hunter et al. | 285/8 |
| 2,702,201 | 2/1955 | Romanelli et al. | 285/8 |
| 3,091,251 | 5/1963 | Hughey | 137/355.28 |
| 3,749,118 | 7/1973 | Berg | 137/355.28 |
| 3,866,957 | 2/1975 | Norton | 285/316 |
| 3,936,031 | 2/1976 | Berman et al. | 251/284 |
| 4,014,467 | 3/1977 | Ferguson | 285/316 |
| 4,164,240 | 8/1979 | Cyphelly | 137/468 |

*Primary Examiner*—A. Michael Chambers

*Attorney, Agent, or Firm*—Zarley, McKee, Thomte, Voorhees & Sease

[57] ABSTRACT

A hose nozzle for a fire fighting kit is provided to utilize the availability of water from a sink faucet to extinguish fires in the home prior to the time fire fighters arrive. An adapter is threaded onto the sink faucet without interrupting the normal use of the faucet. The quick-attach fire fighting kit is stored nearby. The fire hose body can be quickly connected to the adapter by use of a quick connect coupler attached to one end of the hose. The opposite end of the hose body has a nozzle which can be adjusted to control the spray of water therefrom by means of a slidable valve assembly.

11 Claims, 7 Drawing Figures

HOSE NOZZLE FOR FIRE FIGHTING KIT

BACKGROUND OF THE INVENTION

Fires in the home often burn out of control before the fire department arrives. It is therefore desirable to have a convenient means for extinguishing fires in a house. Fire extinguishers are convenient yet have many disadvantages. A chemical fire extinguisher has a limited quantity of material for fighting fires. Also, fire extinguishers commonly leak and therefore may not have the required pressure when needed. Furthermore, fire extinguishers must be recharged after each use.

Therefore, a primary objective of the present invention is the provision of a hose nozzle for a fire fighting kit for use in extinguishing fires in the home.

A further objective of the present invention is the provision of a hose nozzle for a fire fighting kit capable of providing a variety of flow patterns to combat fires of various types.

A further objective of the present invention is the provision of a hose nozzle for a fire fighting kit which can be easily connected to a sink faucet such that there is an unlimited supply of water for fighting fires.

A further objective of the present invention is the provision of a hose nozzle for a fire fighting kit which can be easily and compactly stored and which is reusable.

A still further objective of the present invention is the provision of a durable hose nozzle for a fire fighting kit which is economical to manufacture and easy to use.

SUMMARY OF THE INVENTION

The hose nozzle for a fire fighting kit of the present invention is a home fire protection device designed to utilize the availability of water from a sink faucet to extinguish fires. A nozzle is attached to the foldable hose and is adjustable to control the spray or stream of water by means of a slidable valve. An adapter is threadably attached to the sink faucet and replaces the aerator therein. A quick connect coupler on the opposite end of the hose serves to quickly and releasably attach the hose to the adapter. The coupler can be detached from the end of the hose so that the hose can be connected to a standard water hydrant. The fire hose can be stored in a convenient manner beneath the sink.

DETAILED DESCRIPTION OF THE DRAWINGS

Figure 1:
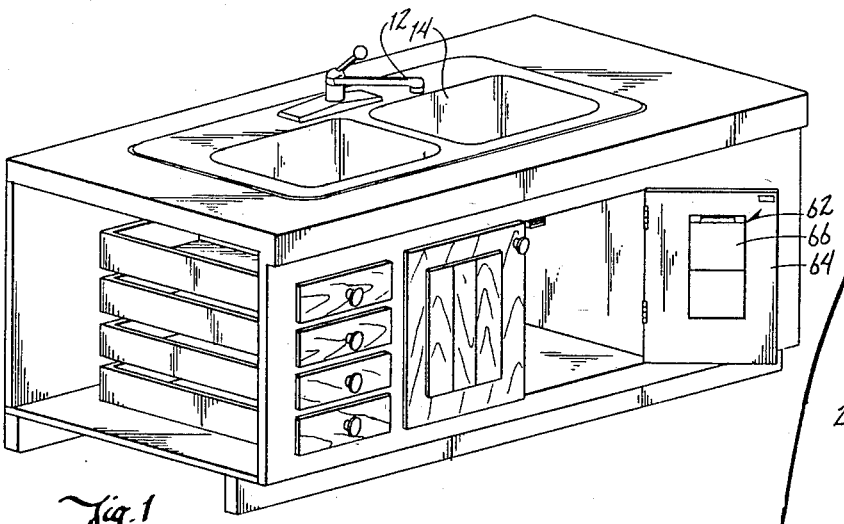
FIG. 1 is perspective view showing the fire hose encased in a plastic box mounted on the inside panel of a cabinet door beneath a kitchen sink.
Figure 2:
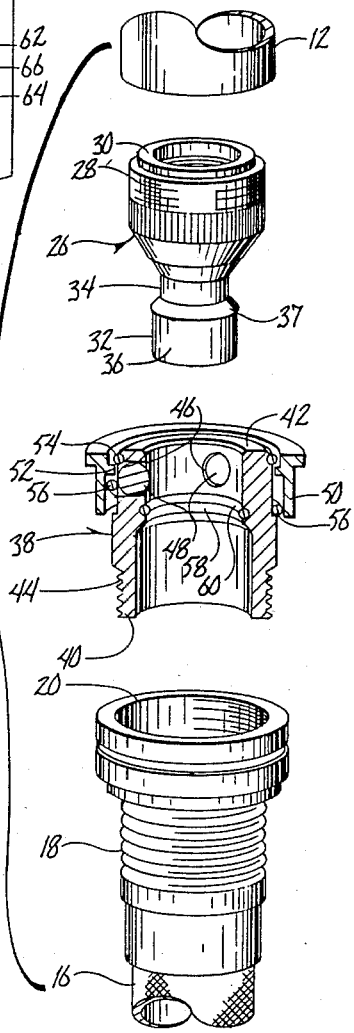
FIG. 2 is an exploded perspective view of one end of the hose.

The hose nozzle for a fire fighting kit of the present invention is generally designated by the numeral 10.

The hose of kit 10 is designed to be attached to the faucet 12 of a sink 14.

Kit 10 includes a main foldable or collapsible hose body 16 which is made of nylon or the like. A conventional brass fitting 18 is attached to one end of hose body 16 and has interior threads 20 for connecting fire hose 10 to a conventional water hydrant. Attached to the opposite end of hose body 16 is a second conventional brass fitting 22 similar to that found on a garden hose. A nozzle 24 can be threaded onto fitting 22 and can be manually adjusted to control the spray of the water from fire hose 10.

Kit 10 also includes an adapter 26. Adapter 26 has exterior threads 28 such that it can be matingly threaded into faucet 12. A plastic or rubber washer 30 provides a water-tight seal between adapter 26 and faucet 12. The adapter 26 also includes an aerator (not shown) which replaces the conventional aerator on faucet 12. The body of adapter 26 may be knurled to provide ease in connecting the adapter to faucet 12. The end 32 of adapter 26 opposite threads 28 thereon has a reduced portion 34 and an integrally attached wider portion 36 defining a shoulder 37 therebetween.

A quick connect coupler 38 has opposite ends 40 and 42. End 40 includes exterior threads 44 such that quick connect coupler 38 can be threaded into fitting 18 of hose body 16. End 42 of coupler 38 has a plurality of openings 46 extending therethrough each of which retentively engage a bearing 48. A bearing guide 50 is slidably mounted over end 42 of coupler 38. Guide 50 includes an inwardly directed flange 52. A retainer ring 54 is fixed to end 42 of coupler 38 to limit the upward movement of guide 50. A spring 56 is also mounted on end 42 of coupler 38 beneath retainer ring 54 so as to limit the downward movement of guide 50 and so as to normally urge guide 50 to the upper position wherein flange 52 is adjacent retainer ring 54. When guide 50 is in the uppermost position, flange 52 thereon engages bearings 48 such that the bearings partially extend into the interior of coupler 38 beyond the inner wall 58 thereof. When guide 50 is in the lowermost position, flange 52 moves beneath bearings 48 such that the bearings are free to move slightly outwardly with respect to the longitudinal axis of coupler 38.

Quick connect coupler is normally attached to fitting 18 of hose body 16 and is designed so that hose body 16 can be quickly attached to adapter 26 which is already in place upon faucet 12. To connect hose body 16 to adapter 26, bearing guide 50 is manually moved to the lowermost position, thus compressing spring 56 and allowing bearings 48 to move outwardly with respect to the longitudinal axis of coupler 38. Coupler 38 is then forced over shoulder 37 of adapter 26 and released such that bearings 48 are forced into reduced portion 34 on adapter 26. When coupler 38 is released, guide 50 is urged upwardly by spring 56 such that flange 52 contacts bearings 48 to force them into reduced portion 34 of adapter 26 thereby locking quick connect coupler 38 onto adapter 26. Hose body 16 is then ready for use. A sealing ring 60 is also provided in coupler 38 to provide a water-tight seal between coupler 38 and adapter 26.

The nozzle 24 is comprised of a hollow tubular housing 24A having a longitudinal center bore 24B. Conventional internal threads 24C appear at the inner end thereof to be attached to a conventional hose fitting 24D on the outer end of hose body 16.

A transverse slot 24E extends through housing 24A and is in communication with center bore 24B. Slot 24E is rectangular in cross section. A sliding valve 24F with spaced apertures 24G and 24H is slidably mounted in slot 24E. Apertures 24G and 24H are adapted to register with bore 24B depending on the position of valve 24F. Aperture 24H has a plurality of arcuate vanes 24I therein to impart rotational turbulance to water passing therethrough to give the water departing from the nozzle 24 a spray or misting quality. Aperture 24G allows departing water to have a narrower high velocity quality. When the center portion 24J of valve 24F is aligned with bore 24B, the flow of water is stopped.

Figure 7:
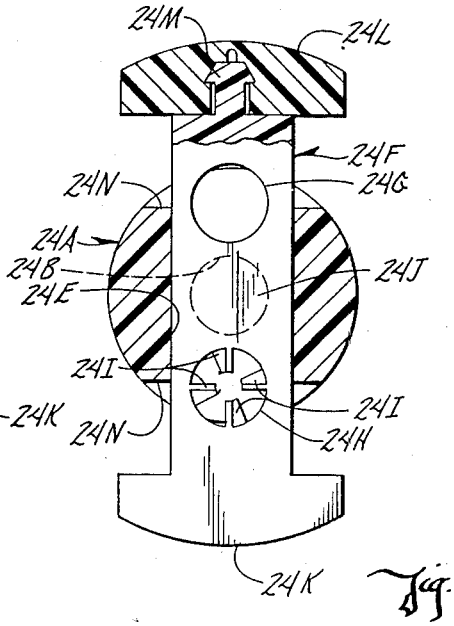
FIG. 7 is an enlarged scale sectional view taken on line 7—7 of FIG. 5.

Valve 24F has an integral stop element 24K on one end and a removal stop element 24L in the other end which is held in place by conventional socket and tab assembly 24M (FIG. 7). The stop elements 24K and 24L are adapted to seat in square shoulder 24N at opposite ends of slot 24E.

Figure 4:
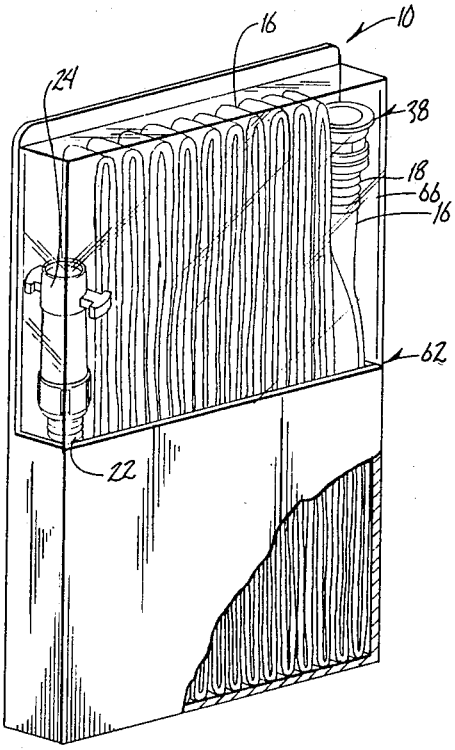
FIG. 4 is a view showing the hose folded for storage within the box container.
Figure 3:
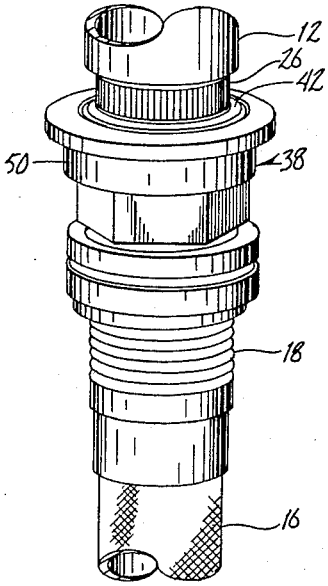
FIG. 3 is a perspective view showing the end of the hose attached to the sink faucet.

Kit 10 is normally stored near sink 14. The hose body 16 can be conveniently folded and the entire hose placed within a container 62 as shown in FIG. 4. Container 62 can be mounted on the inside of a cabinet door 64 beneath sink 14 as shown in FIG. 1. Container 62 includes a removable transparent upper portion 66 which can be quickly removed or opened such that the end of hose body 16 having quick connect coupler 38 can be easily removed therefrom without tangling. When hose body 16 is attached to adapter 26 by coupler 38, the water can be turned on and the end of hose 10 having nozzle 24 can be taken to the source of the fire and the water directed at the base of the fire such that the fire can be extinguished or controlled.

Figure 5:
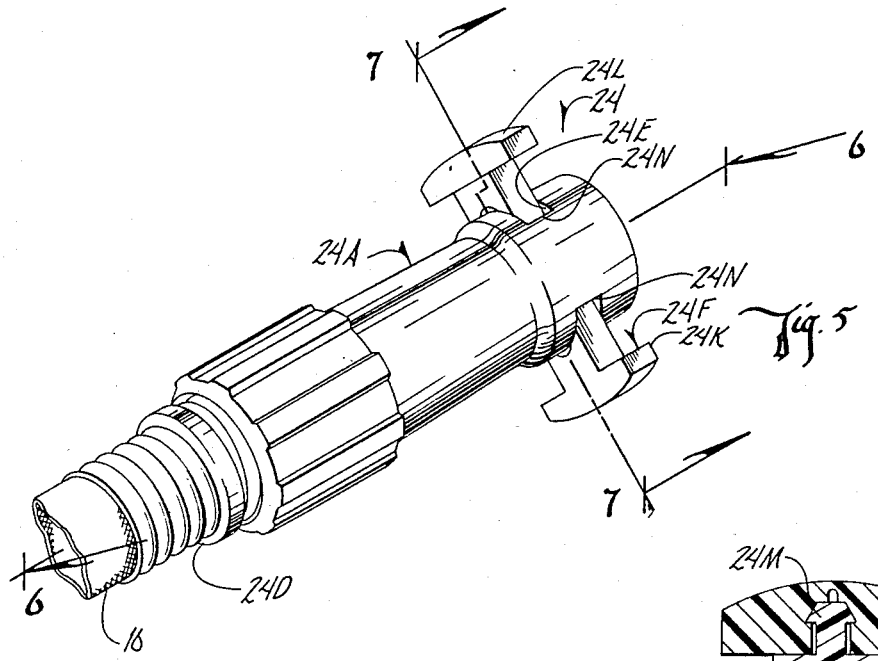
FIG. 5 is a perspective view of the hose nozzle of this invention.
Figure 6:
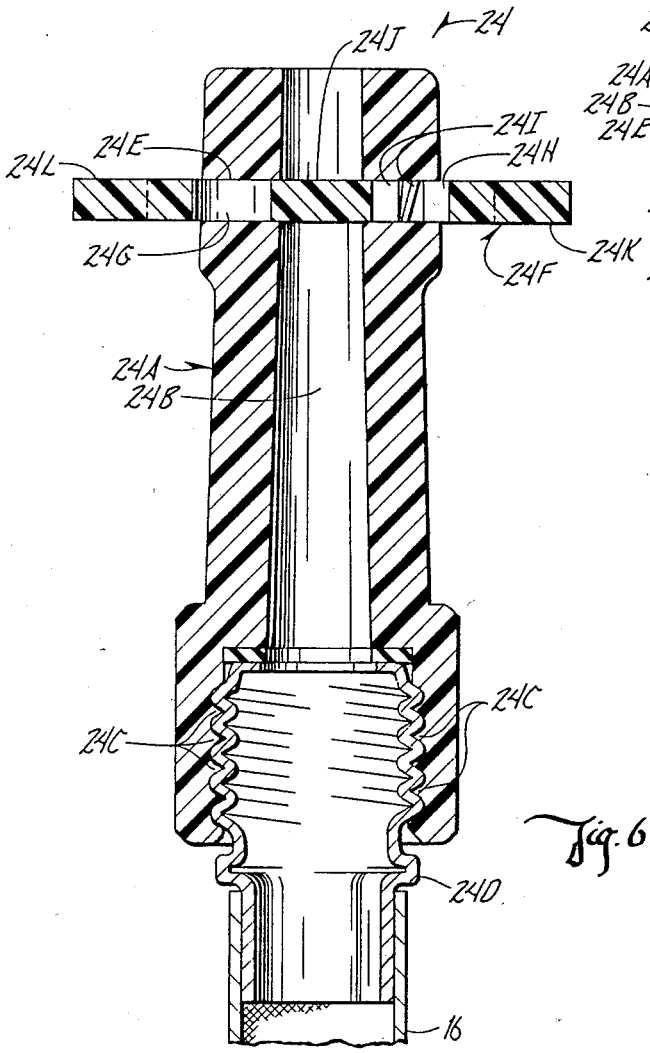
FIG. 6 is an enlarged scale longitudinal sectional view taken on line 6—6 of FIG. 5.

The valve 24F can be quickly moved from its closed position of FIGS. 5–7 to align either of the apertures 24G or 24H with bore 24B, depending on the type of flow pattern desired. The seating of stop elements 24K or 24L on shoulders 24N automatically aligns the apertures 24K or 24L with bore 24B.

As seen by the foregoing, the fire hose body of the present invention can be quickly attached to a water faucet such that a continuous, unlimited supply of water can be used on a fire in the home prior to the time that firefighters arrive.

What is claimed is:

1. A quick-attach fire fighting kit adapted for connection to a water faucet having an aerator thereon, comprising, a portable container, a hose folded in said container and having a nozzle on one end and a quick-attach means on the other end, an adapter for replacing the aerator on a faucet, said adapter having opposite ends, an intermediate body portion and a center longitudinal bore extending from end to end, one end being threaded for connection to a faucet upon removal of the aerator therefrom, the other end including an end insert portion and a reduced diameter portion between said end insert portion and intermediate body portion, said quick-attach means comprising a tubular fitting having a free end and an opposite end adapted for connection to the hose, a guide means slidably mounted on said fitting and movable between connection and disconnection positions, spring means on said tubular fitting normally urging said collar into said connection position; said tubular fitting being adapted to receive the end insert portion of said adapter when said guide means is in its disconnection position, said guide means being adapted to lock said adapter within said tubular fitting when in said connection position.

2. The device of claim 1 wherein sealing means are provided in said tubular fitting to seal said tubular fitting to said adapter when said adapter is locked within said fitting whereby water entering said tubular fitting can flow only into said hose.

3. The device of claim 1 wherein said container has a top portion and a bottom portion, said top portion being of transparent material and being removable from said bottom portion.

4. The device of claim 1 wherein said fitting includes a plurality of apertures, a spherical bearing in each aperture, and flange means on said guide means causing said bearings to protrude into said fitting when said guide means is in its connection position.

5. The device of claim 3 wherein said hose is folded into a plurality of vertically disposed sections with said quick-attach means being positioned at one side of said container in the top portion thereof, and said nozzle is positioned at the other side of said container in the top position thereof.

6. A fire fighting hose nozzle adapted for connection to a threaded fitting on one end of a water hose, comprising, an elongated body member having opposite ends and a center longitudinal bore, threaded connector means on one end of said body member for sealed attachment to a threaded fitting on one end of a water hose, a transverse slot in said body member intersecting said bore, a valve means slidably mounted in said bore and having first and second apertures therein, said apertures being registrable with said bore in response to sliding movement of said valve means in said slot whereby, upon attachment of said body member to a water hose, water under pressure may be directed from the hose through said bore when one of said apertures is in registered position with respect to said bore, said apertures being spaced apart by a dimension greater than the diameter of said bore at said transverse slot, said valve means further comprising first and second stop elements on said valve means adapted to engage said body member and so positioned relative to said apertures that engagement of said first stop element with said body member will register said first aperture with said bore, and engagement of the second stop element with said body member will register the second aperture with said bore, water flow through said bore being blocked upon sliding movement of said valve means to a position with said first and second apertures on opposite sides of said bore and said first and second stop elements being disengaged from said body member.

7. The nozzle of claim 6 wherein each aperture has different fluid flow capabilities.

8. The nozzle of claim 7 wherein at least one of said apertures has a plurality of arcuate vanes.

9. The fire fighting kit of claim 1 wherein said nozzle comprises, an elongated body member having opposite ends and a center longitudinal bore, threaded connector means on one end of said body member for sealed attachment to a threaded fitting on one end of a water hose, a transverse slot in said body member intersecting said bore, a valve means slidably mounted in said bore and having first and second apertures therein, said apertures being registrable with said bore in response to sliding movement of said valve means in said slot whereby, upon attachment of said body member to a water hose, water under pressure may be directed from the hose through said bore when one of said apertures is in registered position with respect to said bore, said apertures being spaced apart by a dimension greater than the diameter of said bore at said transverse slot, said valve means further comprising first and second stop elements on said valve means adapted to engage said body member and so positioned relative to said apertures that engagement of said first stop element with said body member will register said first aperture with said bore, and engagement of the second stop element with said body member will register the second aperture with said bore, water flow through said bore being blocked upon sliding movement of said valve means to a position with said first and second apertures on opposite sides of said bore and said first and second stop elements being disengaged from said body member.

10. The fire fighting kit of claim 9 wherein each aperture has different fluid flow capabilities.

11. The fire fighting kit of claim 10 wherein at least one of said apertures has a plurality of arcuate vanes.

* * * * *